United States Patent [19]

Engelbart

[11] 4,371,102

[45] Feb. 1, 1983

[54] TROUSER PRESSING APPARATUS

[76] Inventor: Wilhelm Engelbart, Sieben Hügel Nr. 5, 4800 Bielefeld, Fed. Rep. of Germany

[21] Appl. No.: 176,524

[22] Filed: Aug. 8, 1980

[30] Foreign Application Priority Data

Aug. 8, 1979 [CA] Canada ..... 333404

[51] Int. Cl.[3] ..... D06F 71/28

[52] U.S. Cl. ..... 223/73; 38/14

[58] Field of Search ..... 38/14; 223/72, 73, 74

[56] References Cited

U.S. PATENT DOCUMENTS

| | | | |
|---|---|---|---|
| 2,956,714 | 10/1960 | Rosenthal et al. | 223/74 |
| 3,160,335 | 12/1964 | Jackson | 223/73 |
| 3,484,028 | 12/1969 | McMillan | 223/73 |

FOREIGN PATENT DOCUMENTS

| | | | |
|---|---|---|---|
| 2193108 | 2/1974 | France | 223/73 |

*Primary Examiner*—Louis Rimrodt

*Attorney, Agent, or Firm*—Watson, Cole, Grindle & Watson

[57] ABSTRACT

The invention relates to an apparatus for pressing pants or like garments in a single operation. There is disclosed novel pressing means and a pressing method.

4 Claims, 12 Drawing Figures

TROUSER PRESSING APPARATUS

The present invention relates to a pressing apparatus and more particularly, relates to a pressing apparatus adapted to press a pair of pants or like garment.

The use of pant-pressing apparatuses is well-known in the art; such apparatuses are frequently employed by commercial cleaning establishments and by garment manufacturers. Naturally, the minimization of labour involved in the pressing of the pants is desirable. In many prior art apparatuses, the pants must be switched either from one apparatus to a further apparatus in order to completely press the pants or alternatively, the operator must manually shift the pants from a first position to a second position in order to complete the pressing. Still further, in certain apparatuses, manual pressing is required for certain portions of the pants.

It is an object of the present invention to provide a pressing apparatus wherein the complete pair of pants may be pressed on a single machine wherein the operator of the machine is only required to load/unload the garment.

It is a further object of the present invention to provide novel components for a pants-pressing apparatus, which components may be adapted to known apparatuses.

It is a still further object of the present invention to provide an apparatus and method for pressing pants such as jeans.

In accordance with the first aspect of the invention, there is provided a pants-pressing apparatus which includes a vertically oriented buck and means for retaining the pants in a pressing position with one leg on opposed sides of the buck. Pressing means are provided on each side of the buck to press each pant leg; each pressing means preferably comprises a split-head arrangement. The apparatus also includes means for pressing the upper portion of the pants.

In a further aspect of the present invention, there is provided a preferred construction of means for pressing the upper portion of pants when they are mounted on a pressing apparatus, the means including a pressing member which is moveable into and out of the upper portion of the pants. The pressing member is expandable to move into a pressing engagement with the inside surface of the upper portion of the pants. Also, means are provided for laterally or horizontally moving the pressing member so as to press the entire area of the upper portion.

In a further aspect of the invention, there is provided an improved pressing apparatus for pressing garments such as jeans, the apparatus including a device for suspending the pants approximate the waist/hip area, which device preferably includes means for sealing the top portion to substantially prevent the escape of gaseous material. The apparatus also includes means for sealing the open legs of the pants. The apparatus is provided with means for blowing gaseous material such as steam and/or pressurized air into the pants or like garment to expand or inflate the same. One or more pressing heads are then provided for moving into and out of a pressing relationship with the expanded or inflated pants.

In a further aspect, there is provided a method of pressing a pair of pants which includes the steps of sealing both the open leg portions and open waist portion of the pants,blowing a pressurized gaseous material, preferably steam and/or pressurized air, into the pants, while bringing a pair of pressing heads into contact therewith to effect a pressing of the garment.

In greater detail, in one aspect of the invention, the apparatus includes a vertically-oriented buck with means for retaining the pants in the desired position whereby one leg is placed on each side of the buck. The buck may have an outwardly tapering or a triangular configuration forming the portion against which the legs rest while an upper portion, in the preferred embodiment, is particularly adapted to suspend the pants in the desired position and in addition, to co-operate with a pressing member to press the upper portion and particularly the fly portion of the pants. The buck, as is the case with all pressing heads/bucks, may be of a substantially conventional construction and will include one or more interior chambers fitted with connections for receiving steam, pressurized gaseous materials such as air, and vacuum. Apertures are provided in the outer surface and a fabric covering may be provided.

The pressing of the leg portion of the pants is conveniently completed through the use of pressing means on each side of the buck. Each pressing means preferably comprises a split head pressing arrangement. In such an arrangement, a pair of heads horizontally moveable with respect to each other are mounted on a suitable frame member. The pressing heads are brought into a pressing relationship with the pants and buck and one of the heads may be moved slightly horizontally to tension the pants leg to achieve a superior press. The pressing operation per se is known in the art—i.e. the use of steam, vacuum and pressurized gas.

In a preferred embodiment of the present invention, the vertically-oriented buck is fitted with an upper portion adapted to both suspend the trousers and to cooperate with a pressing member moveable into the upper portion of the trousers. Thus, the upper portion of the buck may be provided with a pair of members, at least one of which is moveable, and having associated therewith means for grasping and retaining the trousers. Such an arrangement will be shown in further detail in the preferred embodiments. However, it should be noted that one or both upper portions of the buck may be moveable if desired.

The pressing member moveable into the upper portion of the pants is preferably moveable in a vertical direction to move into and out of the desired position. Secondly, the pressing member, being of a smaller size than the interior volume of the upper portion of the pants, is moveable both in a horizontal direction and is expandable outwardly to a pressing engagement with the interior surface of the upper portion of the pants. In association with the above, the apparatus is preferably provided with pressing heads moveable into and out of contact with the exterior surface of the upper portion of the pants when the interior pressing member is expanded.

The apparatus may be modified for the pressing of jeans or like garments. To this end, the apparatus may include a vertical pressing buck and means for suspending or mounting the jeans adjacent one surface thereof. Associated with the means for mounting the jeans are means for sealing the complete upper portion at the waist area to minimize escape of gaseous material therefrom. The apparatus also includes means for sealing the bottom open leg portions to also minimize or substantially prevent the escape of pressurized gaseous material therefrom. The apparatus includes means for feeding a pressurized gas/steam into the interior of the jeans to inflate or expand the same. While the pants are expanded, external pressing heads may then be brought into contact with the garment to press the same. By so doing, wrinkles and the like are eliminated from the garment. Furthermore, the garment need not necessarily by provided with a crease such as in a conventional pressing operation.

Having thus generally described the invention, reference will be made to the accompanying drawings illustrating embodiments thereof, in which.

Figure 1:
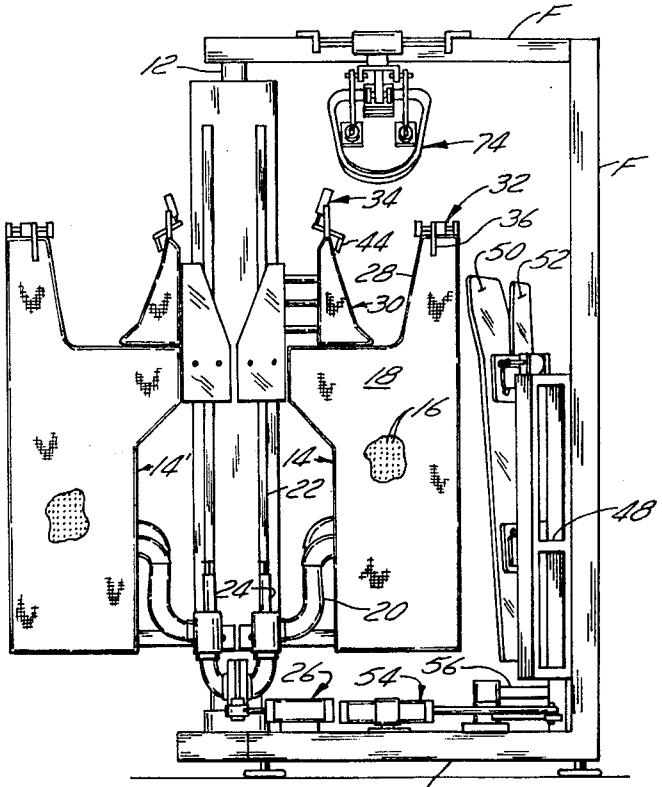
FIG. 1 is a side elevational view embodiment of an apparatus.

Referring to the drawings in greater detail, and by reference characters thereto, the apparatus, as illustrated in FIG. 1, includes a frame member generally designated by F with a center mounting post 12 extending between top and bottom portions thereof. Extending outwardly from post 12 are a pair of vertically-oriented bucks 14 and 14[1]. Each vertically-oriented buck is substantially similar and hence only one will be described herein.

Figure 4:
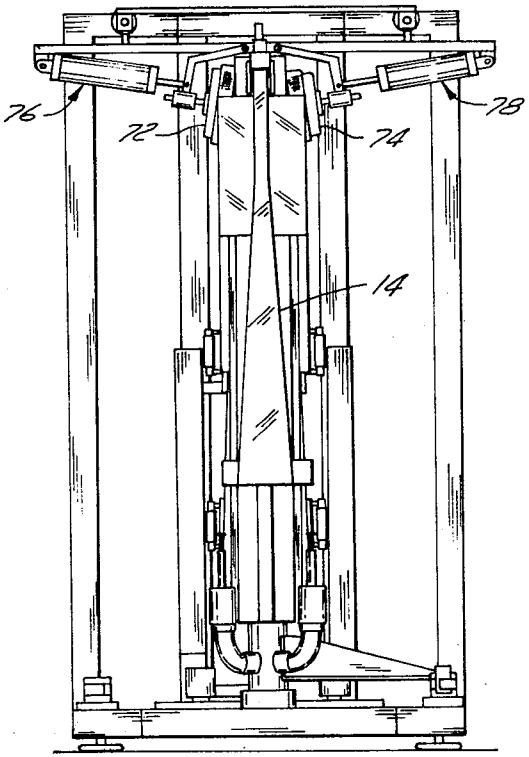
FIG. 4 is an end view of the apparatus illustrating the pressing of the upper portion of the pants.

Buck 14, in the illustrated embodiment, and as seen from FIG. 4, has a somewhat triangular cross-section with a pair of opposed substantially flat sides having apertures 16 therein. The fabric covering 18 may be provided as is conventional in the art. Also, as is conventional, buck 14 is constructed as a conventional pressing buck/head and thus has connections generally designated by reference numeral 20 for supplying steam, pressurized air and a vacuum. One or more internal chambers may be provided. Buck 14 is moveable in a vertical direction along guide rail 22 through piston 24. Thus, when in the position of buck 14[1] as shown in FIG. 1, a pair of pants may be loaded on the buck. Subsequently, the assembly is rotated by means of a piston assembly generally designated by reference numeral 26 to the position of buck 14 in FIG. 1. It may then be raised to the pressing position while the remaining buck is lowered following the pressing position to an unloading/loading position.

As seen in FIG. 1, buck 14 includes an upper portion generally designated by reference numeral 28 extending upwardly from the main body portion of the buck and integral therewith while a further buck generally designated by reference numeral 30 is also provided and which buck 30 has a piston assembly (not shown). Buck 30 also includes connections for supplying steam, vacuum and pressurized gaseous material.

Figure 8:
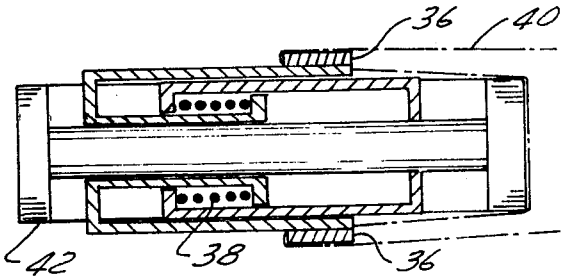
Figure 5:
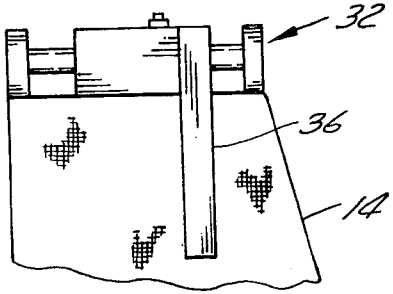
FIG. 5 is a side detail view of a portion of the gripping means for retaining the pants on the apparatus.
Figure 6:
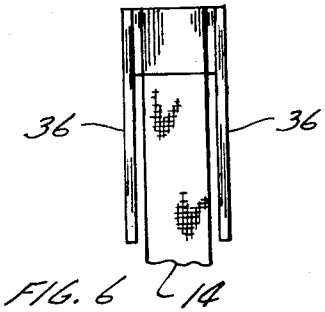
FIG. 6 is an end elevational view of the gripping means at FIG. 5.

Both bucks 14 and 30 have mounting/gripping means associated therewith for retaining the pants in the desired position. Thus, there is provided a first gripping assembly generally designated by reference numeral 32 associated with upper portion 28 of buck 14 and a second gripping assembly 34 associated with buck 30. Gripping assembly 34 is adapted to retain the waist of the pants at the back rear portion thereof. Gripping assembly 32, shown in FIGS. 5–8, include a pair of fingers 36 extending downwardly on opposed sides of upper portion 28 of buck 14. Gripping assembly 32 is provided with an internal spring 38 which is in a relaxed position when the pants (shown in phantom outline at line 40) are mounted about fingers 36. Subsequently, piston 42 is activated to tension the pants as shown in FIG. 8. By so doing, the fly area of the pants is engaged along the inwardly facing surface of portion 28 of buck 14. At the same time, the fingers are generally aligned with the desired crease line to be formed in the leg of the pants.

As aforementioned, gripping assembly 34 is adapted to retain the rear of the pants and to this end, member 44 fits within the pants at the waist area. Buck 30 can then be activated to tension the pants to the desired degree.

Figure 2:
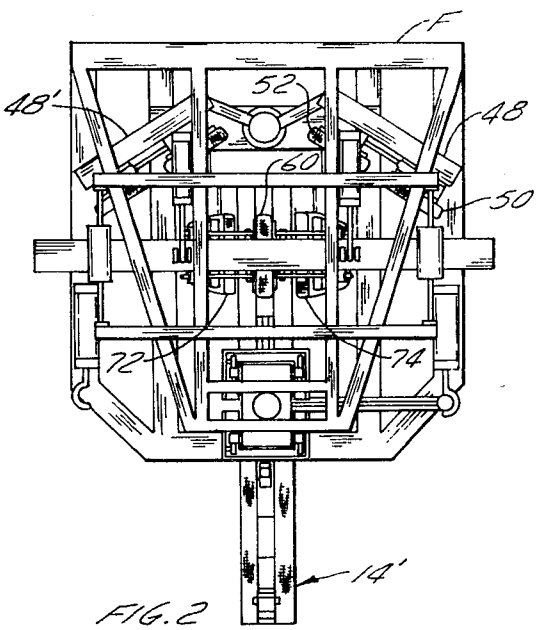
FIG. 2 is a top view of the apparatus at FIG. 1.

The apparatus includes a pair of pressing means for pressing the legs of the pants in co-operation with buck 14. Thus, as may best be seen in FIGS. 1 and 3, there is provided a frame member 48 which carries a pair of pressing heads 50 and 52. Similar pressing means as shown in FIG. 2, are provided on the opposed side of buck 14; frame member 48[1] carrying a pair of pressing heads.

Frame member 48 and pressing heads 50 and 52 are moveable into and out of a pressing relationship with buck 14 by means of a cylinder assembly 54 and associated linkage 56 to move both frame members 48 and 48[1] into a pressing relationship with the side of buck 14. Pressing heads 50 and 52 are of a conventional construction and thus, are not illustrated in detail. As is conventional, they will include steam, vacuum and a pressurized gas connection; their surface is typically covered with a fabric and apertures are provided through the surface of the pressing head.

Figure 3:
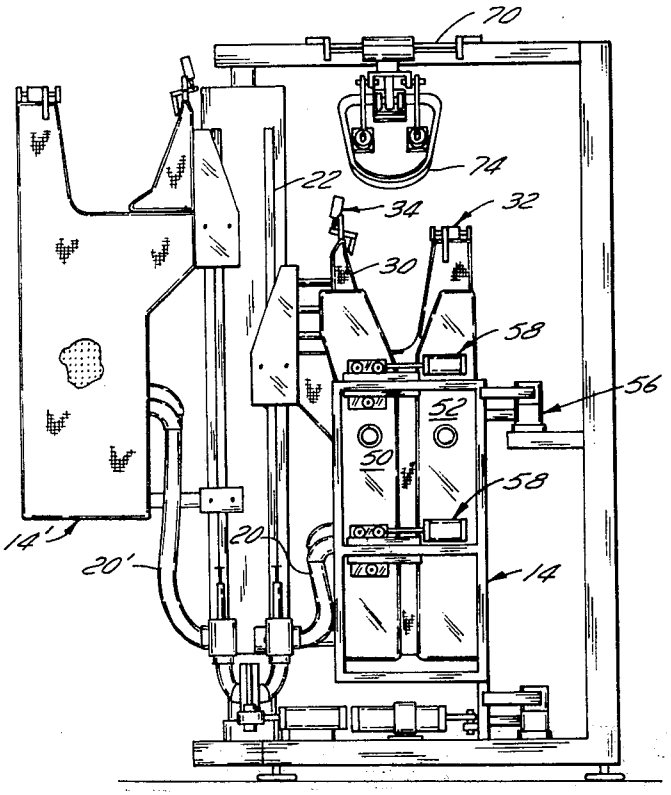
FIG. 3 is a side elevational view of the apparatus with the pressing heads in a pressing position.
Figure 7:
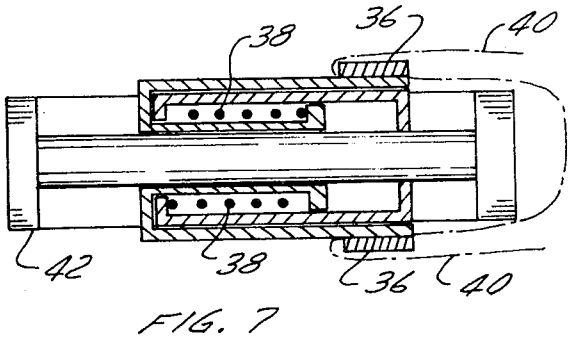
FIGS. 7 and 8 are cross-sectional views of the gripping means.

As shown in FIG. 3, pressing head 50 is moveable horizontally or laterally relative to pressing head 52 by means of a piston assembly 58. Thus, following the activation of piston 54 through linkages 56 to bring pressing heads 50 and 52 into contact with the pant legs mounted on the buck 14, pressing head 50 may be moved slightly horizontally to "tension" the pant legs and to provide a better crease therein.

Figure 9:
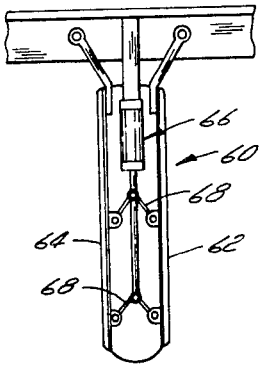
FIG. 9 is an end view of the center pressing member for pressing the upper portion of the pants.

The upper portion of the pants (upper portion extending from the crotch area to the waist) is capable of being pressed on the same apparatus which presses the pants legs. Reference will now be had to FIG. 9 illustrating one embodiment of an upper pressing member.

As shown in FIG. 9, upper pressing member 60 comprises a pair of pressing heads 62 and 64 which are schematically illustrated. A center piston 66 through linkages 68 is adapted to "expand" pressing member 60 by pushing pressing heads 62 and 64 apart. As seen, the split head arrangement thus employed will expand to provide two like pressing heads 62 and 64 which are then adapted to engage the inner surface of the upper portion of the pants. It will, of course, be understood that the arrangement shown above is schematic and that pressing heads 62 and 64 may be provided with conventional connections and furthermore, may be shaped to the desired configuration of the pants.

Pressing member 60 is mounted on the upper portion of frame F. Pressing member 60 is preferably moveable at least in the horizontal direction along guide bar 70 as shown in FIG. 3. Associated with pressing member 60 are a pair of pressing heads designated by reference numerals 72 and 74 which are adapted to press the exterior of the upper portion of the pants in co-operation with pressing member 60. Pressing heads 72 and 74 are activated by means of piston assemblies 76 and 78 respectively. Pressing heads 72 and 74 are substantially conventional members well known to those skilled in the art and include the usual connections and the like.

In operation, the pants are moved upwardly, while mounted on buck 14, such that pressing member 60 is inserted into the interior of the upper portion of the pants. Subsequently, activation of piston 66 will cause pressing surfaces 62 and 64 to move outwardly (split apart) to engage a portion of the insides of the pants. Pressing heads 72 and 74 are then activated to a pressing position. Subsequently, pressing head 60 may be moved in a lateral or horizontal direction to press remaining portions of the upper portion of the pants in conjunction with pressing heads 72 and 74. In practice, pressing member 60 is of a size such that the maximum of two pressing operations is required for any size of pants. At the same time, pressing member 60 has an end surface (not shown) which is adapted to engage the end surface portion 28 of buck 14 to press the fly area of the pants. This is accomplished by retaining heads 62 and 64 together. If desired, the illustrated arrangement may be changed by also providing means for moving pressing member 60 in a vertical direction rather than moving buck 14. This and other similar changes and modifications is well within the skill of those knowledgeable in the art.

Figure 11:
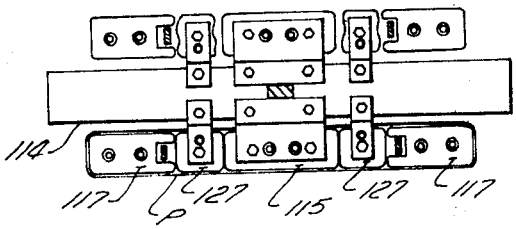
FIG. 11 is a top view of the apparatus at FIG. 10.
Figure 10:
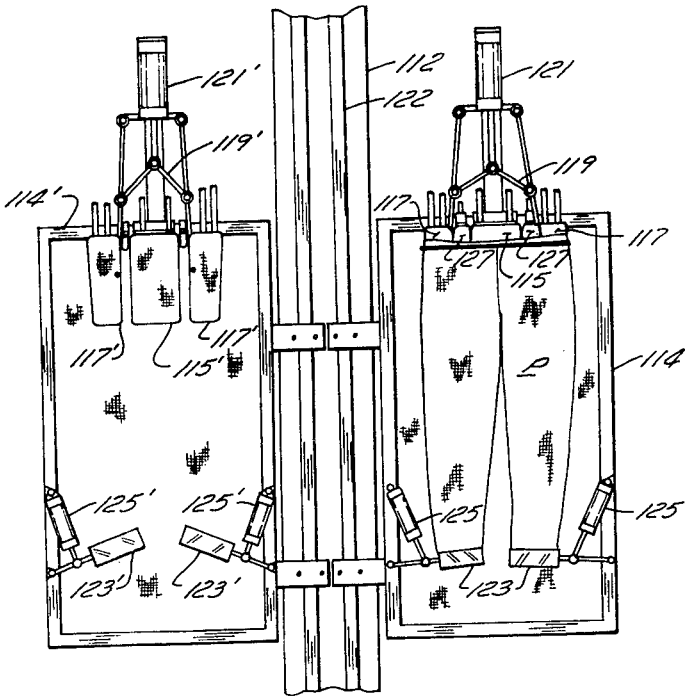
FIG. 10 is a side elevational view of a further embodiment of the apparatus when employed for pressing jeans or like garments.
Figure 12:
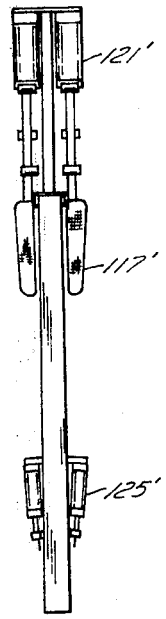
FIG. 12 is an end elevational view thereof.

In the embodiment of FIGS. 10, 11 and 12, a pair of vertically-oriented bucks 114 and 114$^1$ are employed. Buck 114 is similar to buck 14 of FIG. 1 with the exception that a top portion equivalent to portion 28 is not provided. Bucks 114 and 114$^1$ are vertically moveable along track 122 of post 112 and are also rotatable thereabout.

As may be seen from FIG. 10, mounted to one side of buck 114 is a center mounting member 115$^1$ and a pair of suspending and hanging devices 117$^1$. Devices 117$^1$ are connected through linkage 119$^1$ to a cylinder 121$^1$.

Located near the bottom of buck 114$^1$ are a pair of clip members 123$^1$ which are moveable through cylinders 125$^1$.

In operation, a pair of pants such as designated by the reference character P on the right-hand side of FIG. 10 is pulled over devices 117 and member 115 and cylinder 121$^1$ is actuated which, through linkage 119$^1$ moves devices 117$^1$ outwardly to engage the waist area of the pants and thereby suspend and hang the same. Clip members 123 are then actuated to press against the bottom open leg portion of the trousers and seal the same. Intermediate center member 115 and hanging devices 117 are means for sealing the remaining gap at the waist; in the illustrated embodiment, a pair of inflatable members 127 are provided for sealing the gap between devices 117 and member 115. Naturally, flaps or other conventional arrangements may be employed. Following the sealing of the top portion and with the use of clips 123, the pants may be "inflated" with a pressurized gaseous material including steam. Subsequently, one or more pressing heads (not shown) may be brought in contact with the inflated pants to press the same. If desired, the pressure within the pants may be gradually reduced and if desired, the pressing heads may be brought into and out of contact with the pants. As shown in FIG. 12, the arrangement is suitable for pressing a pair of pants on each side of buck 114.

It will be understood that the above described embodiments are for purposes of illustration only and that many changes and modifications may be made thereto. Thus, many standard components known in the art may be employed with the described apparatuses and method and the construction of many of the components such as pressing bucks and/or heads may be readily adapted by those skilled in the art.

I claim:

1. A pants pressing apparatus, comprising an upstanding buck member and a buck element associated therewith, said member and said element being mounted for vertical movement between a lower unloading/loading position and a raised pressing position and for pivoted movement about a vertical axis, means on said member and said element for mounting and suspending a pair of pants from the waist/hip portion thereof, said element being mounted for transverse movement relative to said member for tensioning the waist/hip portion of the pants when suspended, means for retaining and gripping the pants with one leg on each side of said buck member, a pair of pressing means each including first and second pressing heads mounted on frame members movable into and out of pressing engagement with outer sides of the pant legs against said buck member, means for transversely moving said first heads relative to said second heads for tensioning the pants to thereby insure good creases, a pressing member for pressing the upper portion of the pants, said pressing member comprising a split head arrangement which is outwardly expandable into pressing engagement with an inner surface of the waist/hip portion of the pants upon movement of said buck member and said buck element into said raised pressing position, upper pressing heads movable into pressing engagement with said waist/hip portion against said split head arrangement, means for laterally moving said arrangement and said upper heads for pressing different sections of said waist/hip portion.

2. The apparatus according to claim 1, wherein said split head arrangement includes a pair of inner pressing heads and means for moving same into pressing engagement with the inner surface of the waist/hip portion.

3. The apparatus according to claim 1, wherein said buck member includes an upwardly extending buck portion presenting an outer edge against which the fly area of the pants is pressed by said split head arrangement.

4. The apparatus according to claim 1, wherein means are provided for sealing closed the open ends of the pant legs and the upper portion of the pants, means for blowing a pressurized gaseous material including steam into the pants for inflating same, and said pressing means being movable into and out of pressing engagement with the inflated pants.

* * * * *